US007031644B2

(12) United States Patent
Ikeda et al.

(10) Patent No.: US 7,031,644 B2
(45) Date of Patent: Apr. 18, 2006

(54) IMAGE FORMING APPARATUS

(75) Inventors: Takashi Ikeda, Shizuoka-ken (JP); Susumu Nomura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 28 days.

(21) Appl. No.: 10/802,047

(22) Filed: Mar. 17, 2004

(65) Prior Publication Data

US 2005/0207793 A1 Sep. 22, 2005

(51) Int. Cl.
*G03G 15/08* (2006.01)
*G03G 21/10* (2006.01)

(52) U.S. Cl. ..... 399/254; 399/359

(58) Field of Classification Search ..... 399/254–256, 399/358–359

See application file for complete search history.

(56) References Cited

U.S. PATENT DOCUMENTS 5,682,583 A * 10/1997 Ito et al. ..... 399/254
5,734,952 A * 3/1998 Murakami et al. ..... 399/255
5,734,957 A * 3/1998 Ogawa et al. ..... 399/359
5,881,345 A * 3/1999 Yamane et al. ..... 399/255
5,887,224 A * 3/1999 Mizuishi et al. ..... 399/62
5,995,799 A * 11/1999 Nagashima et al. ..... 399/359
6,266,503 B1 * 7/2001 Murayama et al. ..... 399/117
6,611,672 B1 * 8/2003 Aoki et al. ..... 399/359
6,721,534 B1 * 4/2004 Takahashi ..... 399/359
6,829,461 B1 * 12/2004 Arai et al. ..... 399/253
6,892,045 B1 * 5/2005 Tokimatsu et al. ..... 399/359
2004/0033083 A1 * 2/2004 Fukuyama et al. ..... 399/53
2004/0265009 A1 * 12/2004 Shigeta et al. ..... 399/254
2005/0002698 A1 * 1/2005 Jeon ..... 399/254
2005/0002700 A1 * 1/2005 Nishitani ..... 399/258
2005/0111883 A1 * 5/2005 Amano et al. ..... 399/254
2005/0207794 A1 * 9/2005 Katoh et al. ..... 399/254

FOREIGN PATENT DOCUMENTS

EP 0 689 105 A2 * 6/1995
JP 2001-249545 A 9/2001
JP 2001249545 A * 9/2001

OTHER PUBLICATIONS

U.S. Appl. No. 10/802,046, filed Mar. 17, 2004, Ikeda et al.

* cited by examiner

*Primary Examiner*—Yaritza Guadalupe
(74) *Attorney, Agent, or Firm*—Foley & Lardner LLP

(57) ABSTRACT

In an image forming apparatus, the level of the rotational axis of a third mixer 26*a* that conveys and stirs recycle toner is set to be lower than the level of the rotational axis of a second mixer 25*a* at a communicating region with a second chamber 25 that is located on a downstream side of a recycle toner supply section 29.

14 Claims, 8 Drawing Sheets

IMAGE FORMING APPARATUS

BACKGROUND OF THE INVENTION

1. Field of the Invention

The present invention relates to an image forming apparatus that forms an image using a developer.

2. Description of the Related Art

In an image forming apparatus that forms an image using, e.g. a developer including a toner, an electrostatic latent image is formed on a photosensitive drum that serves as an image carrying body. The electrostatic latent image is developed by a developer unit, and a developed toner image is transferred to paper by a transfer unit. The transferred toner image is fixed on the paper by a fuser.

There is known an image forming apparatus of this kind, wherein toner, which remains on the photoconductive drum after the toner image is transferred to the paper, is removed and recovered by a cleaning device. The recovered toner (hereinafter referred to as "recycle toner") is reused.

For example, a toner recycle mechanism is known. According to this mechanism, recycle toner, which is conveyed by a recovery mixer that is provided in a cleaning device, is directly brought back into the developer unit by a coupling mixer that is provided between the cleaning device and the developer unit.

In this case, the recovered toner is always supplied to the developer unit while the recovery mixer and the coupling mixer are being rotated.

As regards the recycle toner to be reused, there are problems: external additive that is inherently provided on toner particles is partly removed, external additive that is removed from other toner particles may adhere to recycle toner, or paper dust is mixed in recycle toner. Compared to fresh toner, the amount of external additive of which is properly set, an initial rise in charge amount of the recycle toner is not good. If frictional charge that is provided by stirring is deficient, toner that is not charged may be fed to the photosensitive drum.

If the non-charged toner is transferred to paper via the photosensitive drum, such problems as fogging of image or dispersion of toner would occur.

BRIEF SUMMARY OF THE INVENTION

According to an aspect of the present invention, there is provided an image forming apparatus comprising: a first chamber including a first mixer disposed in a first axial direction that coincides with an axial direction of an image carrying body which carries an electrostatic latent image, the first mixer stirring and conveying a developer containing at least a toner in a first direction and supplying the toner to the image carrying body; a second chamber disposed adjacent to the first chamber and including a second mixer disposed in parallel to the first mixer, the second mixer stirring and conveying the developer in a second direction different from the first direction; a third chamber disposed adjacent to the second chamber and including a third mixer, the third mixer stirring and conveying the developer in the second direction; a recycle toner supply section that is disposed on an upstream side of the third chamber and is supplied with a recycle toner recovered from a surface of the image carrying body; and a fresh toner supply section that is disposed on an upstream side of the second chamber and is supplied with a fresh toner, wherein an upstream side of an axis of the third mixer is lower than an upstream side of an axis of the second mixer.

According to another aspect of the present invention, there is provided an image forming apparatus comprising: a first chamber including a first mixer disposed in a first axial direction that coincides with an axial direction of an image carrying body which carries an electrostatic latent image, the first mixer stirring and conveying a developer containing at least a toner in a first direction and supplying the toner to the image carrying body; a second chamber disposed adjacent to the first chamber and including a second mixer disposed in parallel to the first mixer, the second mixer stirring and conveying the developer in a second direction different from the first direction; a third chamber disposed adjacent to the second chamber and including a third mixer, the third mixer stirring and conveying the developer in the second direction; a recycle toner supply section that is disposed on an upstream side of the third chamber and is supplied with a recycle toner recovered from a surface of the image carrying body; and a fresh toner supply section that is disposed on an upstream side of the second chamber and is supplied with a fresh toner, wherein a downstream side of an axis of the third mixer is higher than a downstream side of an axis of the second mixer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An image forming apparatus according to an embodiment of the present invention will now be described with reference to the accompanying drawings.

Figure 1:
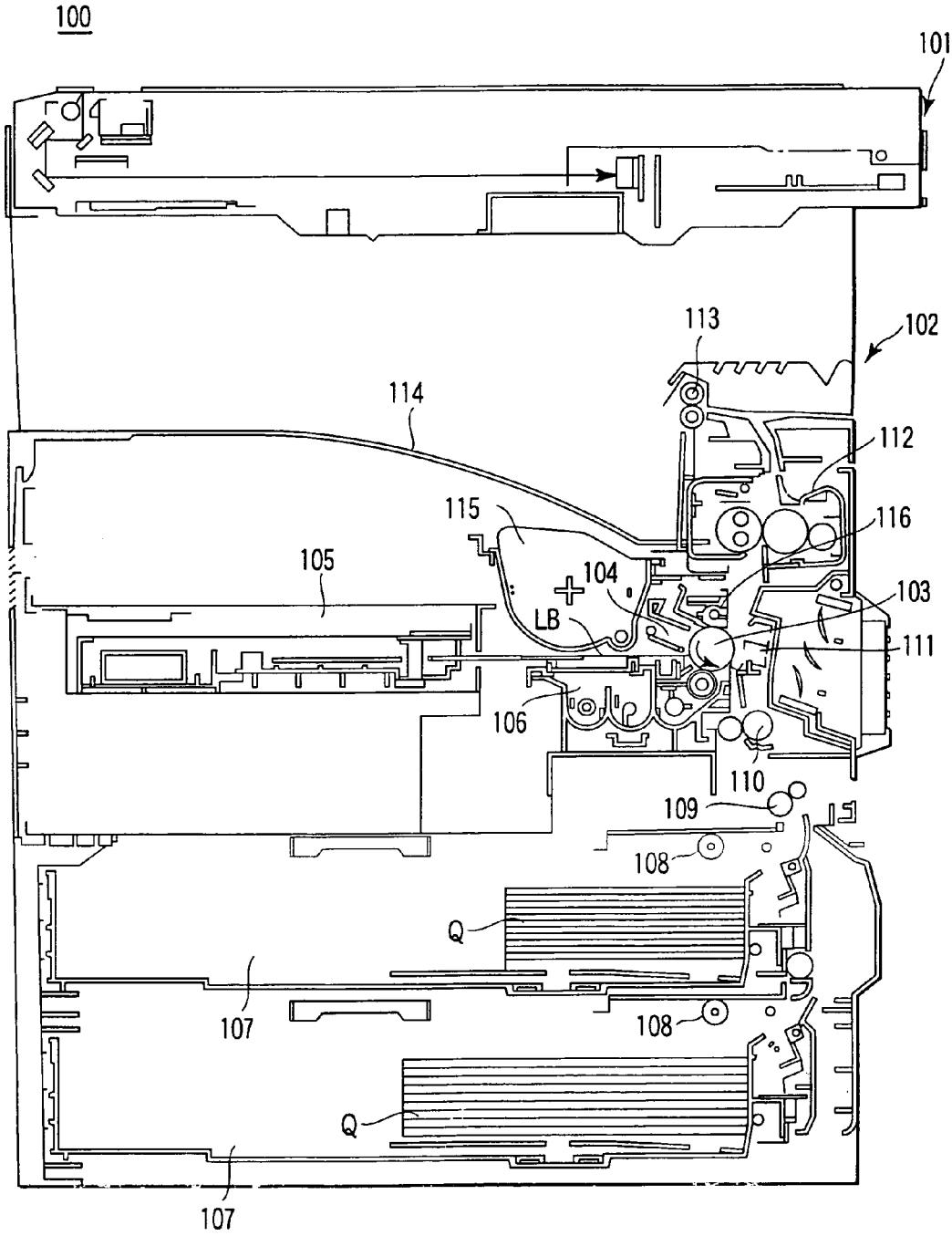
FIG. 1 schematically shows an image forming apparatus according to an embodiment of the present invention.

FIG. 1 is a schematic front view of the image forming apparatus, with the cover being removed.

As is shown in FIG. 1, an image forming apparatus (digital copying machine) 100 includes an image scanning section (scanner) 101, which reads an image on a to-bescanned or to-be-copied object P and produces an image signal, and an image forming section 102, which forms an image based on the image signal produced from the scanner 101 or an image signal that is provided from outside.

The image forming section 102 includes a photosensitive drum 103, a charger 104, an exposing device 105, a developer unit 106, sheet cassettes 107, pickup rollers 108, a convey roller 109, an aligning roller 110, a transfer device 111, a fuser 112, an output roller 113, an output tray 114, a fresh toner supply device 115, and a photosensitive drum cleaner 116.

The photosensitive drum 103 has a photosensitive body on its periphery. The photosensitive body is illuminated in the state in which a predetermined potential is applied thereto. The potential of the illuminated region varies, and an electrostatic latent image, which is formed by the variation in potential, is retained on the photosensitive body for a predetermined time period.

The charger 104 charges the surface of the photosensitive drum 103 with a predetermined potential.

The exposing device 105 is disposed on a downstream side of the charger 104 in the rotational direction of the photosensitive drum 103. The exposing device 105 applies a laser beam LB, which has a light intensity varying in accordance with the image signal supplied from the scanner 101, to the photosensitive drum 103. The laser beam LB can have a predetermined light intensity corresponding to, e.g. the density of an image.

The developer unit 106 is disposed on the downstream side of the exposing device 105 in the rotational direction of the photosensitive drum 103. The developer unit 106 contains a two-component developer that comprises a carrier and a toner. The developer unit feeds developer (e.g. toner) to the surface of the photosensitive drum 103, thereby developing an electrostatic latent image on the surface of photosensitive drum 103 into a visible toner image.

Each sheet cassette 107 contains paper sheets Q, and the pickup roller 108 picks up them one by one. The picked-up sheet is conveyed to the aligning roller 110 by means of the convey roller 109.

The aligning roller 110 rotates at a predetermined timing and conveys the sheet Q to the position for image transfer, thereby to register the positions of the sheet Q and the toner image formed on the photosensitive drum 103.

The transfer device 111 applies a predetermined potential to the paper sheet Q and transfers the toner image formed on the photosensitive drum 103 to the sheet Q.

The fuser 112 applies predetermined heat and pressure to the sheet Q on which the toner image is formed, and fuses the toner image and fixes it on the sheet Q.

The output roller 113 conveys the sheet Q that is output from the fuser 112 to the output tray 114.

The fresh toner supply device 115 supplies fresh toner, which has not been used for image formation, to the developer unit 106 at a predetermined timing.

The photosensitive drum cleaner 116 is disposed on a downstream side of the transfer position, where the transfer device 111 faces the photosensitive drum 103, in the rotational direction of the photosensitive drum 103. The photosensitive drum cleaner 116 recovers toner, or the like, which adheres to the surface of the photosensitive drum 103.

Figure 2A:
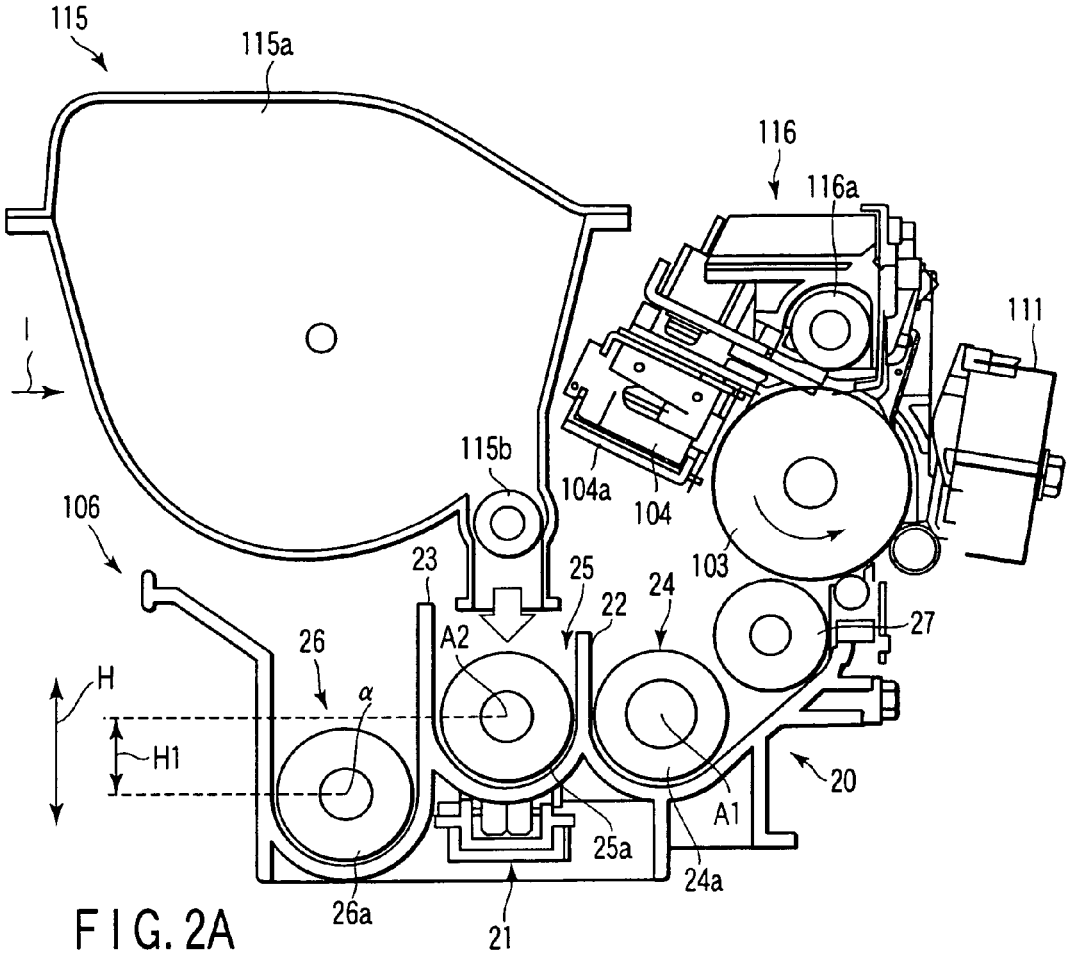
FIGS. 2A and 2B schematically show a developer unit and its peripheral components, which are mounted in the image forming apparatus shown in FIG. 1.
Figure 2B:
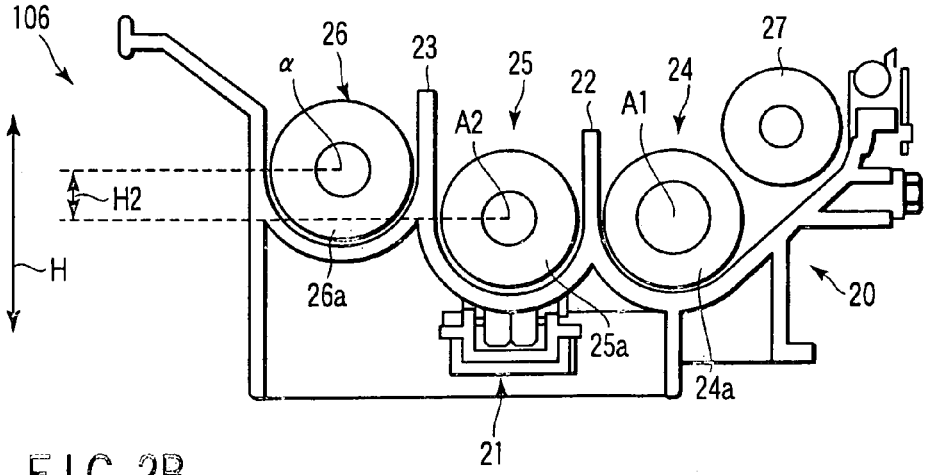
Figure 3A:
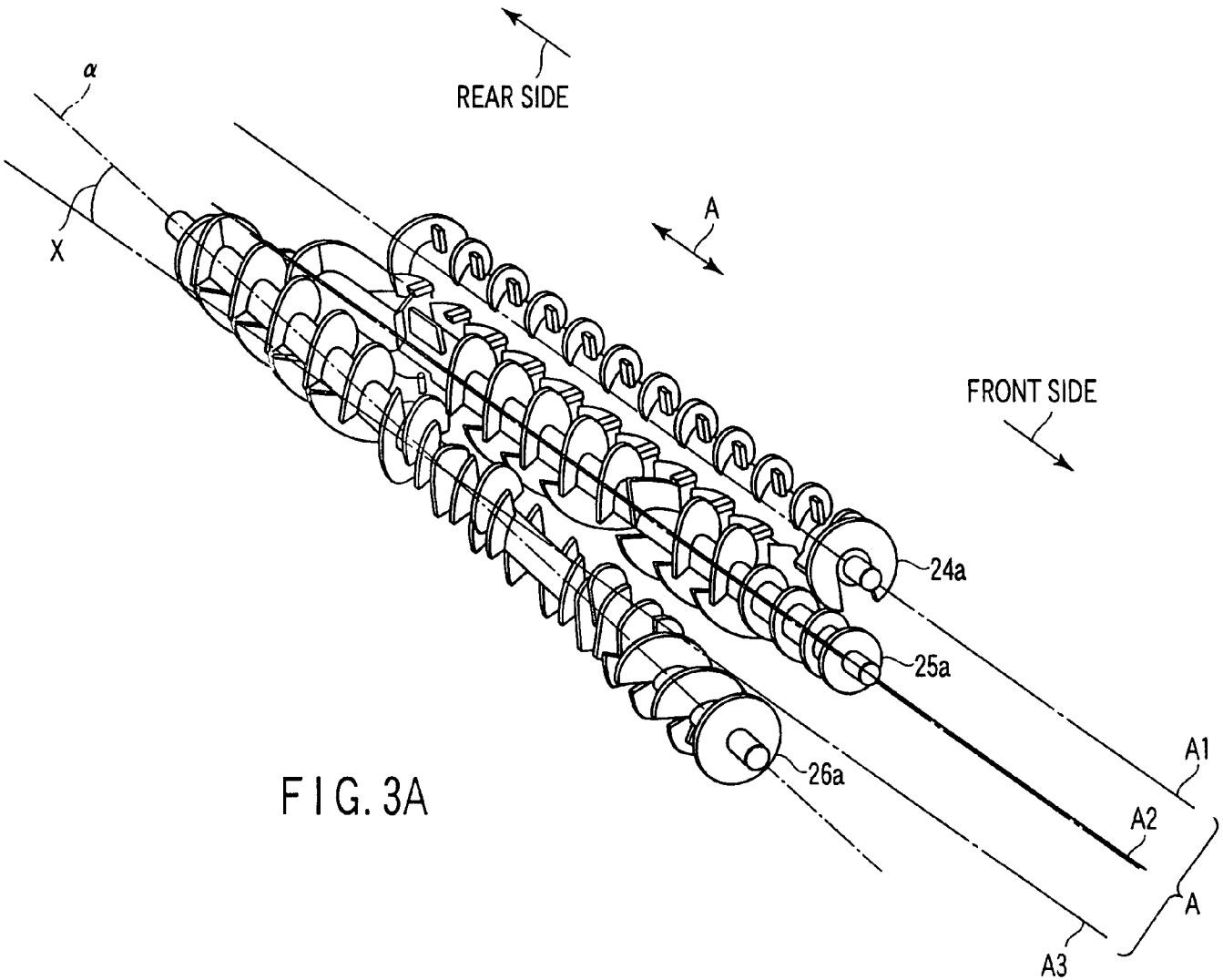
FIGS. 3A and 3B illustrate examples of mixers that are mounted in the developer unit shown in FIGS. 2A and 2B.
Figure 3B:
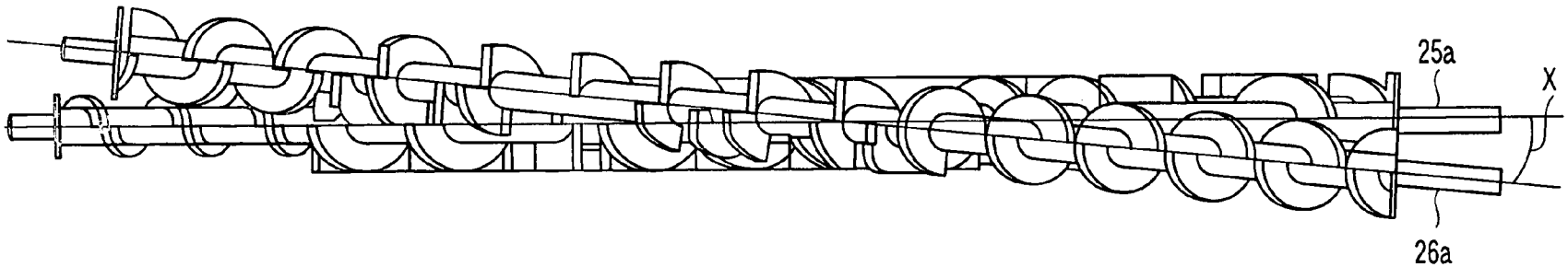
Figure 4:
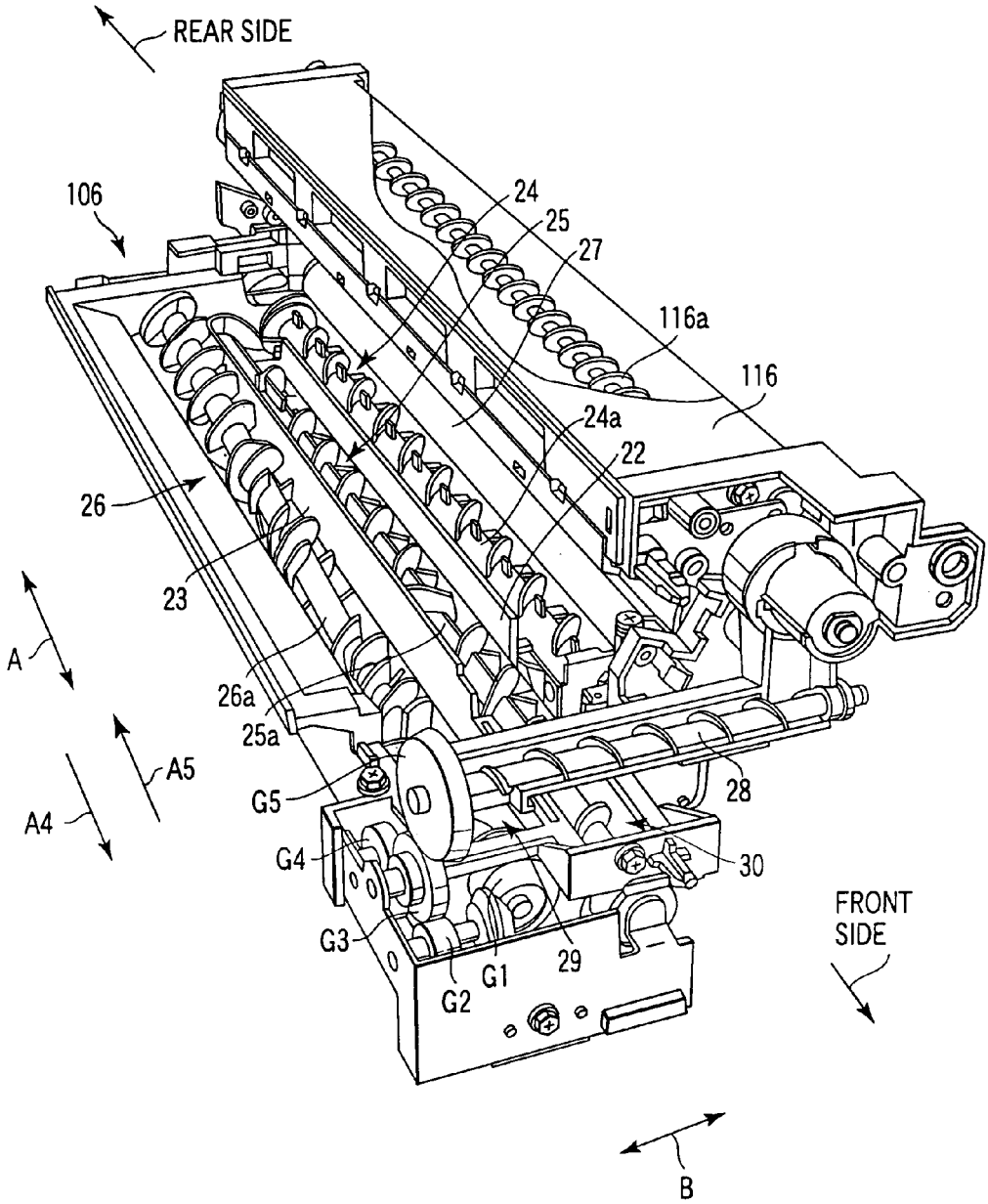
FIG. 4 schematically shows the developer unit shown in FIGS. 2A and 2B.

FIG. 2A is a cross-sectional view that schematically shows the developer unit, as viewed from the front side in the longitudinal direction of the developer unit, or the vicinity of the end parts of mixers. FIG. 2B is a cross-sectional view that schematically shows that part of the developer unit, which is located on the rear side, relative to the center of the developer unit, in the longitudinal direction of the developer unit, or the vicinity of the end parts of mixers. FIGS. 3A and 3B show mixers that are mounted in the developer unit. FIG. 4 is a perspective view of the developer unit.

As is shown in FIG. 2A, the developer unit 106 includes the fresh toner supply device 115 and is disposed to be opposed to the photosensitive drum 103 at a predetermined position. The charger 104 and a charge erase lamp 104*a* are arranged on the upstream side of the position for development, where the photosensitive drum 103 faces the developer unit, in the rotational direction of the photosensitive drum 103. On the downstream side of the position for development, the transfer device 111 and photosensitive drum cleaner 116 are arranged in the named order.

The fresh toner supply device 115 includes a fresh toner cartridge 115*a* that contains fresh toner, and a supply roller 115*b* that is rotated at a predetermined timing and supplies fresh toner to a predetermined position in a second chamber 25.

The photosensitive drum 116 includes a recycle toner convey roller 116*a* that conveys recovered recycle toner to the rear side.

The developer unit 106 includes a developer container 20 that contains a two-component developer (hereinafter referred to as "developer") that comprises a carrier and a toner, and a magnetic sensor 21 that detects the concentration of toner contained in the developer container 20. The magnetic sensor 21 should preferably be disposed at a lower part of the developer container 20.

The developer container 20 is partitioned by a first partition 22 and a second partition 23, each having a predetermined length in the axial direction of the photosensitive drum 103, and comprises a first chamber 24, the second chamber 25 and a third chamber 26. The first partition 22 has such a predetermined length that the first chamber 24 and second chamber 25 are coupled at the rear and front sides. The second partition 23 has such a predetermined length that the second chamber 25 and third chamber 26 are coupled at the rear and front sides (see FIG. 4).

The first chamber 24 includes a first mixer 24*a* that has an axis A1 parallel to an axial direction A (see FIG. 3A) of the photosensitive drum 103. The second chamber 25 includes a second mixer 25*a* that has an axis A2 parallel to the axial direction A of the photosensitive drum 103. A developing roller 27 is rotatably provided in the first chamber 24. The developing roller 27 is opposed to the surface of the photosensitive drum 103 at a position for development, and supplies developer (toner) to the drum 103.

The third chamber 26 includes a third mixer 26*a* with an axis α that is set in a predetermined direction relative to an imaginary axis A3, which is parallel to the axial direction A of photosensitive drum 103, as shown in FIGS. 3A and 3B. For example, the axis α is inclined by a predetermined angle X, relative to the imaginary axis A3.

In other words, the axis α of the third mixer 26*a* is a non-parallel skew line, relative to the axis A1 of first mixer 24*a* and the axis A2 of second mixer 25*a*.

(1) For example, the axis α of the third mixer 26*a* crosses the imaginary axis A3 near the center point thereof. The axis α is shifted downward by a predetermined degree on the front side and is shifted upward by a predetermined degree on the rear side.

In other words, as shown in FIG. 2A, the front-side axis α of the third mixer 26*a* is lower than the axis A2 of the second mixer 25*a* by a height H1 in the height direction H.

In addition, as shown in FIG. 2B, the rear-side axis α of the third mixer 26*a* is higher than the axis A2 of the second mixer 25*a* by a height H2 in the height direction H.

As is shown in FIG. 4, a recycle toner supply mechanism 28 is disposed on the front side of the developer unit 106. The recycle toner supply mechanism 28 conveys recycle toner, which is supplied from the photosensitive drum cleaner 116, to the third chamber 26.

The recycle toner supply mechanism 28 has an axis in a direction B that is preset, e.g. in relation to the axial direction A of the photosensitive drum 103. The recycle toner supply mechanism 28 is a mixer that is provided with helical blades and is able to convey recycle toner by rotational motion.

The recycle toner from the recycle toner supply mechanism 28 is fed to a recycle toner supply section 29 that is located on the front side of the third chamber 26.

Figure 7:
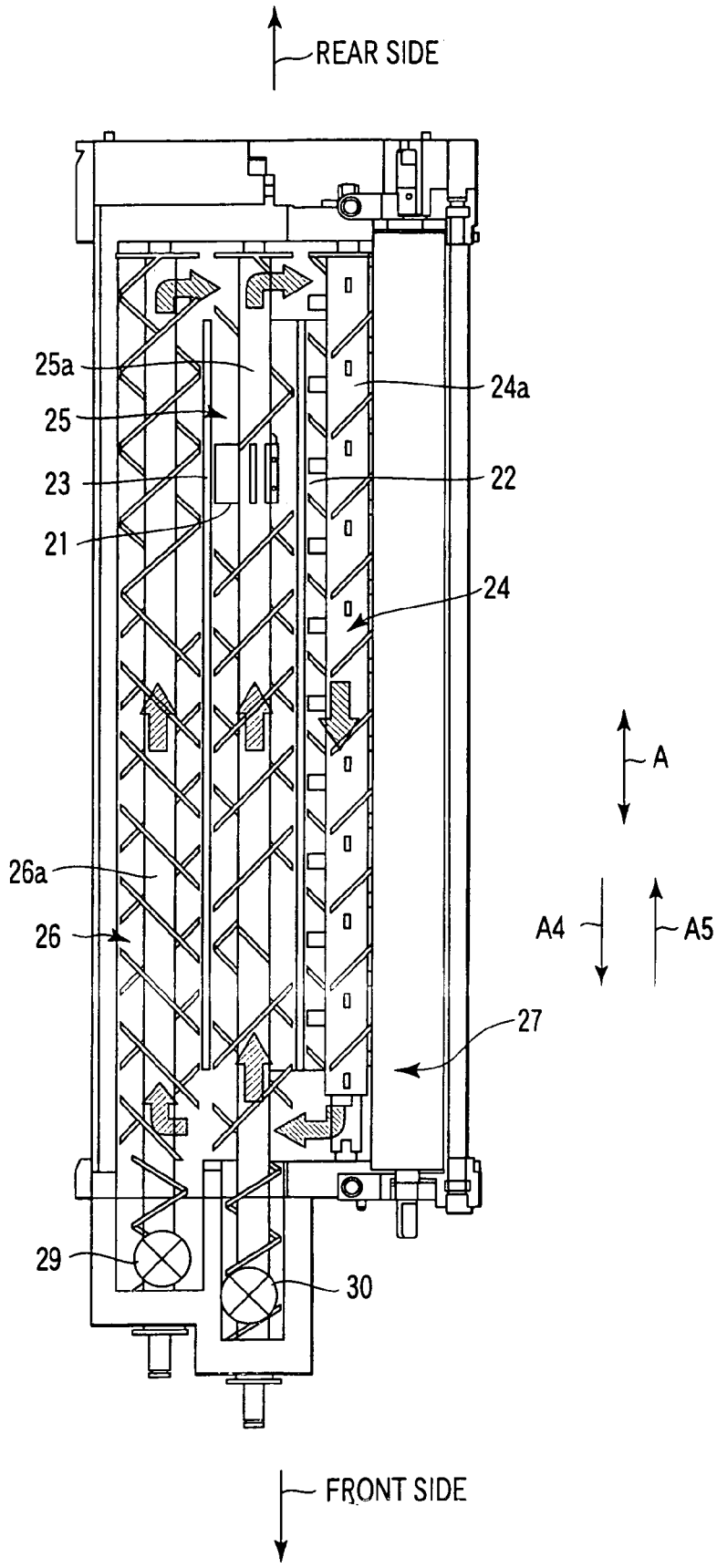
FIG. 7 is a schematic view for describing the operation of the developer unit shown in FIGS. 2A and 2B.

A fresh toner supply section 30 is provided on the front side of the second chamber 25, that is, on the same side as the recycle toner supply section 29. Fresh toner from the fresh toner supply device 115 is brought to the fresh toner supply section 30. As is shown in FIG. 7, the fresh toner supply section 30 may be located on the upstream side (front side) in the toner conveyance direction of the third chamber 26, relative to a region where the second chamber 25 and third chamber 26 communicate with each other. Thereby, a longer distance for recycle toner conveyance can be secured.

The first mixer 24*a* is rotated to stir and convey the developer in the first chamber 24 at a first speed in a first direction A4 from the rear side to the front side. In other words, the first mixer 24*a* stirs and conveys the developer, which is received from the second mixer 25*a* and third mixer 26*a*, and delivers it to the developing roller 27. In addition, the first mixer 24*a* receives developer, which is removed from the developing roller 27 after development, and conveys it.

The second mixer 25*a* is rotated to stir and convey the developer in the second chamber 25 at a second speed in a second direction A5 from the front side to the rear side. The second speed may be equal to the first speed. In other words, the second mixer 25*a* has a function of stirring and conveying the developer that is received from the first mixer 24*a*, and a function of stirring and conveying the fresh toner received from the fresh toner supply device 115, along with the developer, and delivering it to the first mixer 24*a*.

The third mixer 26*a* is rotated to stir and convey the developer in the third chamber 26 at a third speed in the second direction A5 from the front side to the rear side. It should suffice if the third speed is such a speed that a sufficient frictional charge can be applied to the recycle toner. In other words, the third mixer 26*a* stirs and conveys the recycle toner that is received from the recycle toner supply mechanism 28, along with the developer, and delivers it to the second mixer 25*a*.

Specifically, the recycle toner supply section 29 is located on the upstream side of the developer (comprising toner and carrier) that is moved in the second direction A5 in the third chamber 26 by the rotation of the third mixer 26*a*. In other words, the recycle toner supply section 29 is located on the front side of the rotational axis α of the third mixer 26*a*, that is, at a lowest position in the direction of axis α.

The fresh toner supply section 30 is located on the upstream side of the developer (comprising toner and carrier) that is moved in the second direction A5 in the second chamber 25 by the rotation of the second mixer 25*a*, and on the upstream side of the communicating part between the second chamber 25 and third chamber 26.

Figure 5A:
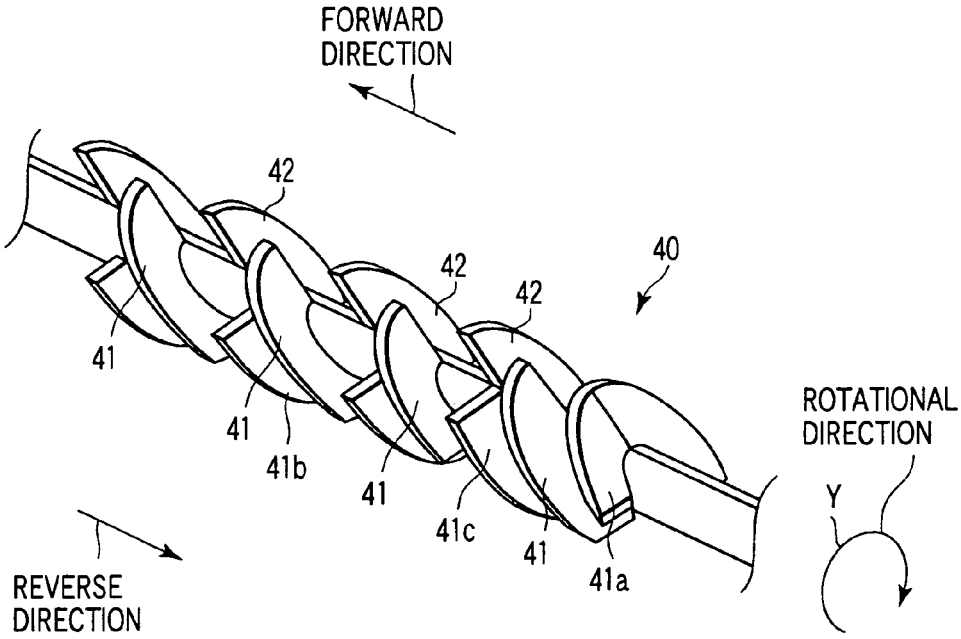
FIGS. 5A and 5B are views for explaining the mixers that are mounted in the developer unit shown in FIGS. 2A and 2B.
Figure 5B:
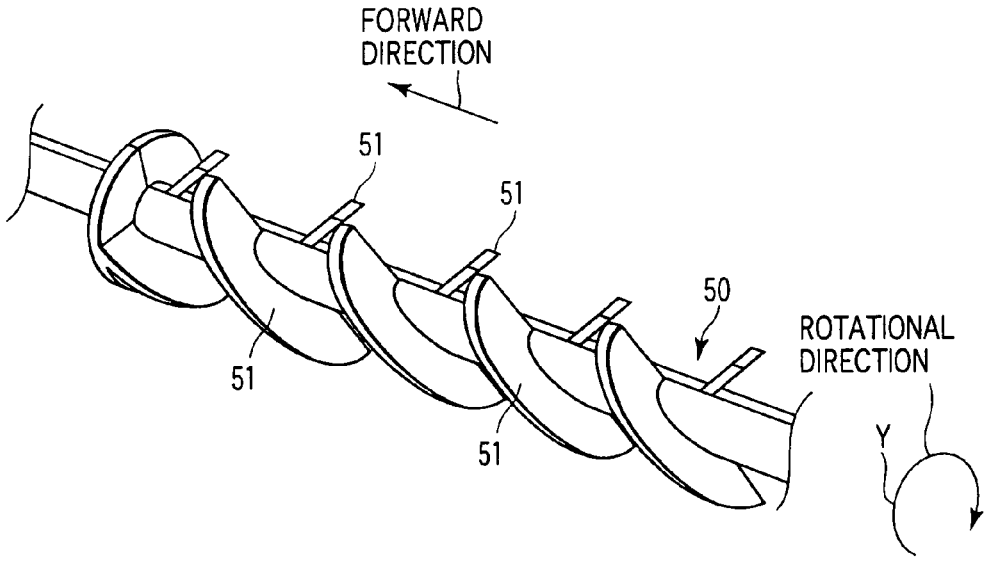

The third mixer 26*a* may be configured like a mixer 40 shown in FIG. 5A, and each of the first and second mixers 24*a* and 25*a* may be formed like a mixer 50 shown in FIG. 5B.

As is shown in FIG. 5A, the mixer 40 includes forward feed blades 41, which are rotated in a predetermined direction Y to convey developer in a forward direction, and reverse feed blades 42, which convey developer in a direction reverse to the forward direction. In the mixer 40, compared to the mixer 50 shown in FIG. 5B, which comprises only forward feed blades 51, the time for conveying the developer in the forward direction is shorter. The mixer 40 can convey the developer at a predetermined speed in accordance with the ratio in total area between the forward feed blades 41 and reverse feed blades 42. If speed change is to be effected more finely, the area of each blade may be varied, as shown in FIG. 5A. In FIG. 5A, the size of a forward feed blade 41*a*, 41*b* is ½ of that of the forward feed blade 41, and the size of a forward feed blade 41*c* is ⅔ of that of the forward feed blades 41.

Thus, the third speed is lower than the first or second seed. For example, the third speed is ½, ⅓ or ⅙ of the first or second speed. The degree of stirring of developer in the third chamber can be made greater than that of the stirring of developer in the first or second chamber. Hence, the degree of stirring of recycle toner that is conveyed in the third chamber can be made greater than the degree of stirring of fresh toner. Therefore, the difference in charge level between the fresh toner and recycle toner can be minimized.

It should suffice if the height H1 is determined such that the recycle toner that is supplied to the recycle toner supply section 29 is prevented from being conveyed to the adjacent second chamber 25.

A gear G5 is coupled to one end portion of a center shaft of the recycle toner supply mechanism 28. The gear G5 is engaged with a gear G1, which is coupled to the rear-end portion of the third mixer 26*a* in the axis α, via a gear G2 that is meshed with the gear G1 as well as gears G3 and G4. The recycle toner supply mechanism 28 is rotated by a torque that is transmitted from a main motor 55 (see FIG. 6). Although not shown, the gears G2, G3 and G4 should preferably be coupled to the photosensitive drum 103, recycle toner convey roller 116*a* and first to third mixers 24*a* to 26*a*.

Hence, the photosensitive drum 103, recycle toner convey roller 116*a*, first to third mixers 24*a* to 26*a* and recycle toner supply mechanism 28, which are coupled by the gears G1 to G5, can be rotated at the same time by the rotation of the main motor.

In the second chamber 25, the magnetic sensor 21 is disposed on the downstream side of the fresh toner supply section 30 in the direction of movement of the developer.

In the case where both the recycle toner supply section 29 and fresh toner supply section 30 are disposed on the front side, as in the present embodiment, the length of the front-side part of the second chamber 25 in the axial direction A may be made greater than that of the third chamber 26 so that the front-side part of the second chamber 25 projects to the front side. This can prevent overlapping of the recycle toner supply mechanism 28 and fresh toner supply section 30.

Figure 6:
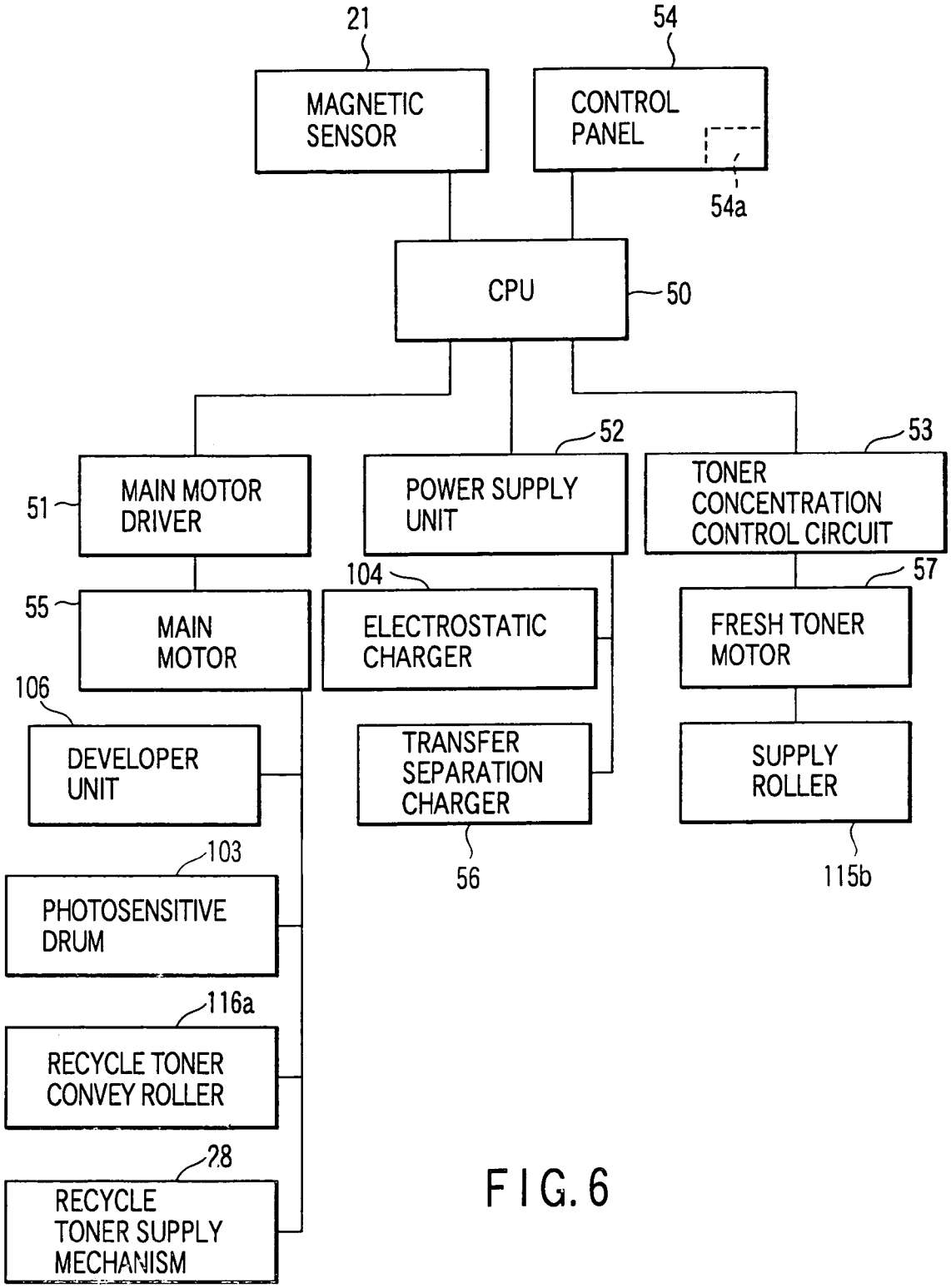
FIG. 6 is a block diagram illustrating a control system of an image forming section shown in FIG. 1.

FIG. 6 is a block diagram illustrating a control system of the image forming section 102 shown in FIG. 1.

As is shown in FIG. 6, a CPU 50 is connected to a main motor driver 51, a power supply unit 52, a toner concentration control circuit 53, a control panel 54 and the magnetic sensor 21.

The control panel 54 includes a display section 54*a*, through which a user instructs predetermined operations. For example, the user instructs image scan by the scanner 101, image formation by the image forming section 102, or both of image scan and image formation.

The magnetic sensor 21 detects, as a toner concentration, the ratio of toner (e.g. resin) to carrier (e.g. iron or ferrite), which are contained in the developer container 20 of the developer unit 106. The magnetic sensor 21 outputs a detection value to the CPU 50. The CPU 50 compares the detection value of toner concentration from the magnetic sensor 21 with a predetermined reference value. If the detection value is lower, the CPU 50 outputs a toner supply signal to the toner concentration control circuit 53. To be more specific, the CPU 50 outputs to the toner concentration control circuit 53 such a toner supply signal as to supply toner for a predetermined time period in accordance with the level of a voltage that is input from the magnetic sensor 21. This level of voltage is representative of the toner concentration.

The main motor driver 51 is connected to the main motor 55. Upon receiving an image formation instruction from the control panel 54, the main motor driver 51 outputs to a drive signal to the main motor 55.

The main motor 55 is coupled to the first to third mixers 24*a* to 26*a* and developing roller 27 of the developer unit 106, the photosensitive drum 103, the recycle toner convey roller 116*a* and the recycle toner supply mechanism 28. Upon receiving the drive signal from the main motor driver 51, the main motor 55 applies a predetermined drive force.

The power supply unit 52 is connected to the charger 104 and a transfer separation charger 56. Upon receiving an image scan instruction from the control panel 54, the power supply unit 52 produces a predetermined voltage after a predetermined elapsed time or immediately.

The charger 104 is supplied with a predetermined voltage from the power supply unit 52 and applies a predetermined charge to the surface of the photosensitive drum 103.

The toner concentration control circuit 53 is connected to the fresh toner motor 57. Upon receiving a toner supply signal from the CPU 50, the fresh toner motor 57 operates only for a predetermined time period.

The fresh toner motor 57 drives the supply roller 115*b*, which is controlled by the toner concentration control circuit 53, thereby supplying a predetermined amount of fresh toner to the fresh toner supply section 30.

In short, the supply amount of fresh toner can be determined in accordance with the level of toner concentration in the developer container 20. For example, if the toner concentration considerably decreases, the supply time of fresh toner becomes longer.

The operation of the image forming apparatus 100 will now be described. In this embodiment, image formation is performed using a reverse development method.

Assume that both image scan and image formation have been instructed through the control panel 54. In this case, the scanner 101 starts image scan. In the image forming section 102, the power supply unit 52 outputs a predetermined voltage and causes the charger 104 to apply charge. Since the image formation is instructed at the same time, the main motor driver 51 outputs a drive signal to the main motor 55.

The scanner 101 includes, for instance, a light source, a lens and a charge-coupled device (CCD). Reflective light from a to-be-copied object is focused on a light-receiving surface of the CCD via the lens. The CCD photoelectrically converts the reflective light to an image signal. The obtained image signal is output to the exposing device 105 and converted to a laser beam LB with a predetermined light intensity.

The laser beam LB is applied to the surface of the photosensitive drum 103, which has been uniformly electrified with a negative charge by the charger 104. The potential of that part of the surface of the photosensitive drum 103, which has been illuminated with the laser beam LB, decreases close to zero. Hence, an electrostatic latent image is formed on the surface of the photosensitive drum 103.

Negatively charged toner in the developer unit 106 is attracted to the latent image on the surface of the photosensitive drum 103, which has been illuminated with the laser beam LB so as to have a predetermined potential level. Thus, a toner image is formed on the surface of the photosensitive drum 103.

The toner image is transferred to a paper sheet Q that is conveyed by the aligning roller 110 to the position for transfer and is positively charged by the transfer device 111.

The toner image that is transferred to the paper sheet Q is fused and fixed by the fuser 112. In short, an image is formed on the paper sheet Q.

The paper sheet Q, on which the image is formed by the fuser 112, is discharged to the output tray 114 by the output roller 113.

On the other hand, the toner, which has not been transferred from the surface of the photosensitive drum 103 and has moved to the photosensitive drum cleaner 116, is recovered by the photosensitive drum cleaner 116.

The recovered recycle toner is collected to the front side by the recycle toner convey roller 116*a*. The collected recycle toner is brought to the recycle toner supply section 29 via the recycle toner supply mechanism 28. Thus, the recycle toner is reused. On the other hand, if a decrease in toner concentration within the developer container 20 is detected by the magnetic sensor 21, the toner density control circuit 53 drives the fresh toner motor 57 for a predetermined time period (i.e. by a predetermined number of rotations), thereby supplying fresh toner to the fresh toner supply section 30.

If the toner concentration that is detected by the magnetic sensor 21 does not increase even if the toner concentration control circuit 53 outputs the drive signal for a predetermined time period or more and drives the supply roller 115*b*, the display section 54*a* displays such indication that the fresh toner within the fresh toner cartridge 115*a* has been consumed, thus notifying the user of the runout of toner.

Next, referring to FIG. 7, the operation of the developer unit 116 is described.

If image formation (or image formation involving image scan) is instructed through the control panel 54, the main motor driver 51 of the image forming section 102 outputs a drive signal to the main motor 55.

Upon receiving the drive signal, the main motor 55 operates to rotate the first to third mixers 24*a* to 26*a* and developing roller 27 of the developer unit 106 in predetermined directions at substantially equal speeds.

The recycle toner supplied from the recycle toner supply section 29 is stirred and conveyed in the second direction A5 in the third chamber 26, along with the developer that is already present in the third chamber 26 and the developer coming from the upstream side (front side) of the second chamber 25. The developer stirred in the third chamber 26 on the downstream side is conveyed into the downstream-side part of the second chamber 25.

The fresh toner supplied to the fresh toner supply section 30 is conveyed and stirred in the second direction A5 in the second chamber 25, along with the developer coming from the first chamber 24. The developer stirred in the second chamber 25 on the downstream side is conveyed into the upstream side of the first chamber 24.

The developer conveyed to the upstream side of the first chamber 24 is further conveyed in the first direction A4, while being stirred. The developer is then guided to the surface of the photosensitive drum 103 by the developing roller 27.

Since the recycle toner is stirred and conveyed in the third chamber 26 at the third speed, it is sufficiently charged by friction. When the developer reaches the upstream side of the first chamber 24, the difference in charge level between the fresh toner and recycle toner can be minimized.

The upstream side of the third mixer 26*a* of the third chamber 26 is lower than the upstream side of the second chamber 25 in the height direction H. Thus, even when the developer unit 116 is inclined, it is possible to prevent the recycle toner from reversely flowing to the second chamber 25 and entering the third chamber 26. Hence, it is possible to prevent the recycle toner from entering the second chamber 25 and being conveyed to the first chamber 24 in the state in which the recycle toner is not sufficiently stirred. Therefore, problems such as fogging of image can be prevented.

Moreover, since the downstream side of the third mixer 26*a* is higher than the downstream side of the second chamber 25 in the height direction H, the developer can smoothly be conveyed to the second chamber 25.

In the present embodiment, it is preferable that the ratio between carrier and toner of the two-component developer in the developer container 20 be set at about 95% (% by mass):5% (% by mass). The ratio between carrier and toner is detected by the magnetic sensor 21. Based on the detection result, toner is supplied from the fresh toner supply device 115.

In the present embodiment, the second and third mixers 25*a* and 26*a* have a phase displacement in the height direction on the front and rear sides, as described in the aforementioned feature (1). Alternatively, (2) the axis α may cross the imaginary axis A3 on the rear side, with a phase displacement on the front side and without a phase displacement on the rear side, or (3) the axis α may cross the imaginary axis A3 on the front side, with a phase displacement on the rear side and without a phase displacement on the front side.

What is claimed is:

1. An image forming apparatus, comprising:

a first chamber including a first mixer disposed in a first axial direction that coincides with an axial direction of an image carrying body which is disposed adjacent to the first chamber to carry an electrostatic latent image, the first mixer stirring and conveying a developer containing at least a toner in a first direction and supplying the toner to the image carrying body;

a second chamber disposed opposite to the image carrying body with the first chamber interposed therebetween and including a second mixer disposed in parallel to the first mixer, the second mixer stirring and conveying the developer in a second direction different from the first direction;

a third chamber disposed opposite to the image carrying body with the first chamber and the second chamber interposed therebetween and including a third mixer, the third mixer stirring and conveying the developer in the second direction;

a recycle toner supply section that is disposed on an upstream side of the third chamber and is supplied with a recycle toner recovered from a surface of the image carrying body; and a fresh toner supply section that is disposed on an upstream side of the second chamber and is supplied with a fresh toner, wherein an upstream side of an axis of the third mixer is lower than an upstream side of an axis of the second mixer.

2. The image forming apparatus according to claim 1, wherein the second mixer conveys the developer at a first speed, and the third mixer conveys the developer at a second speed that is lower than the first speed.

3. The image forming apparatus according to claim 2, wherein the second speed is ⅓ of the first speed.

4. The image forming apparatus according to claim 1, wherein the first chamber is disposed at a same height as the second chamber.

5. The image forming apparatus according to claim 1, wherein the axis of the third mixer is a non-parallel skew line, relative to an axis of the first mixer and the axis of the second mixer.

6. The image forming apparatus according to claim 1, further comprising a recycle toner supply mechanism which supplies the recycle toner supply section with the recycle toner recovered from the surface of the image carrying body.

7. The image forming apparatus according to claim 6, further comprising a drum cleaner which recovers the recycle toner from the surface of the image carrying body and delivers the recycle toner to the recycle toner supply mechanism.

8. An image forming apparatus, comprising:

a first chamber including a first mixer disposed in a first axial direction that coincides with an axial direction of an image carrying body which is disposed adjacent to the first chamber to carry an electrostatic latent image, the first mixer stirring and conveying a developer containing at least a toner in a first direction and supplying the toner to the image carrying body;

a second chamber disposed opposite to the image carrying body with the first chamber interposed therebetween and including a second mixer disposed in parallel to the first mixer, the second mixer stirring and conveying the developer in a second direction different from the first direction;

a third chamber disposed opposite to the image carrying body with the first chamber and the second chamber interposed therebetween and including a third mixer, the third mixer stirring and conveying the developer in the second direction;

a recycle toner supply section that is disposed on an upstream side of the third chamber and is supplied with a recycle toner recovered from a surface of the image carrying body; and a fresh toner supply section that is disposed on an upstream side of the second chamber and is supplied with a fresh toner, wherein a downstream side of an axis of the third mixer is higher than a downstream side of an axis of the second mixer.

9. The image forming apparatus according to claim 8, wherein the second mixer conveys the developer at a first speed, and the third mixer conveys the developer at a second speed that is lower than the first speed.

10. The image forming apparatus according to claim 9, wherein the second speed is ⅓ of the first speed.

11. The image forming apparatus according to claim 8, wherein the first chamber is disposed at a same height as the second chamber.

12. The image forming apparatus according to claim 8, wherein the axis of the third mixer is a non-parallel skew line, relative to an axis of the first mixer and the axis of the second mixer.

13. The image forming apparatus according to claim 8, further comprising a recycle toner supply mechanism which supplies the recycle toner supply section with the recycle toner recovered from the surface of the image carrying body.

14. The image forming apparatus according to claim 13, further comprising a drum cleaner which recovers the recycle toner from the surface of the image carrying body and delivers the recycle toner to the recycle toner supply mechanism.

* * * * *